US006830224B2

(12) United States Patent
Lewin et al.

(10) Patent No.: US 6,830,224 B2
(45) Date of Patent: Dec. 14, 2004

(54) RAIL COMMUNICATIONS SYSTEM

(75) Inventors: Henry B. Lewin, Arlington, VA (US); Alfred D. Granite, Arlington, VA (US)

(73) Assignee: Railroad Transportation Communication Technologies (RTCT) LLC, Warrenton, VA (US)

( * ) Notice: Subject to any disclaimer, the term of this patent is extended or adjusted under 35 U.S.C. 154(b) by 0 days.

(21) Appl. No.: 10/204,325

(22) PCT Filed: Feb. 26, 2001

(86) PCT No.: PCT/US01/05934

§ 371 (c)(1),
(2), (4) Date: Aug. 21, 2002

(87) PCT Pub. No.: WO01/62572

PCT Pub. Date: Aug. 30, 2001

(65) Prior Publication Data

US 2003/0010872 A1 Jan. 16, 2003

(51) Int. Cl.[7] ..... B61L 15/00

(52) U.S. Cl. ..... 246/167 R; 246/63 A; 701/20

(58) Field of Search ..... 246/167 R, 63 C, 246/63 A, 63 R, 19 A, 34 R, 34 CT; 701/19, 20; 455/456.5, 456.6, 458, 469, 74, 78, 3.01

(56) References Cited

U.S. PATENT DOCUMENTS

| | | | | |
|---|---|---|---|---|
| 1,517,549 A | | 12/1924 | Espenschied | |
| 3,694,751 A | | 9/1972 | Takahashi et al. | 325/51 |
| 3,714,419 A | | 1/1973 | Fosse et al. | |
| 3,715,669 A | | 2/1973 | LaForest | |
| 3,750,020 A | | 7/1973 | Baba et al. | 325/5 |
| 3,949,959 A | * | 4/1976 | Rhoton et al. | 246/34 CT |
| 4,074,879 A | * | 2/1978 | Clark et al. | 246/37 |
| 4,207,569 A | * | 6/1980 | Meyer | 342/44 |
| 4,369,942 A | | 1/1983 | Wilson | |
| 4,420,133 A | * | 12/1983 | Dietrich | 246/167 R |
| 4,442,988 A | * | 4/1984 | Laurent et al. | 246/34 CT |
| 4,491,967 A | * | 1/1985 | Kobayashi et al. | 455/41.2 |
| 4,498,650 A | | 2/1985 | Smith et al. | 246/122 |
| 4,645,148 A | * | 2/1987 | Kolkman | 246/34 A |
| 4,655,421 A | * | 4/1987 | Jaeger | 246/167 R |
| 4,910,793 A | | 3/1990 | Mainardi | 455/55 |
| 5,019,815 A | * | 5/1991 | Lemelson et al. | 340/933 |
| 5,330,134 A | * | 7/1994 | Ehrlich | 246/34 R |
| 5,507,456 A | | 4/1996 | Brown et al. | |
| 5,548,815 A | * | 8/1996 | Takayama et al. | 455/41.1 |
| 5,749,547 A | * | 5/1998 | Young et al. | 246/4 |
| 5,867,404 A | * | 2/1999 | Bryan | 714/724 |
| 6,102,340 A | * | 8/2000 | Peek et al. | 246/121 |
| 6,216,985 B1 | * | 4/2001 | Stephens | 246/120 |

FOREIGN PATENT DOCUMENTS

EP 0 861 764 9/1998

OTHER PUBLICATIONS

European Search Report dated May 25, 2004.

* cited by examiner

*Primary Examiner*—Frantz F. Jules
(74) *Attorney, Agent, or Firm*—Crowell & Moring LLP

(57) ABSTRACT

A method and apparatus for transmitting an information carrying signal, such as an electromagnetic frequency signal or an acoustic signal, through the tracks of a railroad to a remote position on the track where the information is extracted. The extracted information can be used to relate speed and location of trains, location of obstructions, and/or track conditions. The in situ track (10) is evaluated using an autoranging digital multimeter which establishes the resistance between two opposite rails (12, 14).

30 Claims, 3 Drawing Sheets

RAIL COMMUNICATIONS SYSTEM

BACKGROUND OF THE INVENTION

The present invention relates to information transmission along railroad tracks. Conventional communication along railroad tracks between stations or between trains and stations involves conventional radio frequency transmission or sophisticated satellite communications. Each of these systems require command centers, repeaters and other signal enhancing devices to provide uninterrupted information. Conventional radio transmission has inherent difficulties resulting from not only environmental interference and blackout, but also loss of communication with trains while passing through tunnels or certain terrains.

Prior attempts to utilize the features of railroad tracks for generating information or for communicating between sections involved the application of electricity in either pulsed or modulated form wherein the information of the signal was transmitted as a function of relay systems placed at intervals along the track or is a function of interruptions of constant signals along the track which needed to be monitored at short intervals.

U.S. Pat. No. 1,517,549 uses an electrical high frequency signal because it eliminated information concerning trains that were much further ahead and not considered a danger. This high frequency limited the signal because of high attenuation characteristics.

U.S. Pat. No. 3,715,669 to LaForest used a receiver for a frequency modulated overlay track circuit wherein components such as relay capacitors and resistors were connected to the rail and its operation depended upon the wheels of the train interrupting an electrically generated signal through the track by use of a shunt which blocks signals to the transmitter.

The U.S. Pat. No. 3,949,959 to Rhoton and U.S. Pat. No. 3,984,073 to Wood et al. concern antenna apparatus for coupling audio frequency signals related to one or the other of vehicle track rails. Voltage is injected into the vehicle track rails. This system is related to the detection of sound waves.

U.S. Pat. No. 4,369,942 to Wilson is a signal communication system which uses an electrically generated current including insulated tracks to engage a rail crossing signal wave system. Low voltage current initiates or induces the signal.

Other forms of proposed communication include the utilization of a wave guide principle wherein the track bed and the bottom of a moving train acted as a "wave guide" in the reference to Myers, U.S. Pat. No. 4,207,569.

Another form of transmission included the use of a transponder system by Birken in U.S. Pat. No. 4,932,614 wherein a rail current was set up in order to complete a loop through a shunt or a short circuit at the end of a track segment.

The U.S. Pat. No. 4,442,988 to Laurent et al. passes information through rails by using transmission zones with a resonant circuit tuned to a carrier frequency of signals emitted by a conductive loop placed between two rails of the track at the end of each block or zone. This system uses a continuous wave transmission in order to detect information rather than communicate information from one position to another.

These systems have the disadvantage that they are only able to be used over short distances or that they depend on interruptions in signal to generate information or that the signal itself represents the information which is subjected then to attenuation and noise related problems when substantial distances of track are involved.

SUMMARY OF THE INVENTION

The present invention overcomes prior art problems by providing an improved method and apparatus for transmitting and receiving information or general communication, including but not limited to location, speed and direction of rail traffic, to operators, and other personnel.

It is an object of the present invention to allow for transmission and or reception of information utilizing the existing rail system as both the transmission and reception medium for a variety of signals including radio frequency, acoustic, and lightwave systems.

The present invention accomplishes its objective by using conventional railroad steel tracks which are mounted on railroad ties. These rails are electrically coupled to each successive length of track by conductive cable or a solid weld. Railroad equipment traverses the rails using a flanged steel wheel which rolls on top of the steel rail. The present invention provides for transmission and reception of signals directly into the rail through a suitable tuned inductor or through the wheel into the rail. The transmitted signals are received from the rail back through the wheel, or tuned inductor, or other suitable conductive media to the equipment. Additionally, a variety of electromagnetic induction or conduction devices may be utilized in the vicinity of the track. Current federal regulations prohibit any part of the equipment mounted on a train, other than the wheel, from being any closer to the rail then 2.5 in. (6.35 cm).

It is another object of the present invention to avoid any noncompliance with the FCC (Federal Communications Commission) regulations prohibiting radio and other frequency interference, while also providing a reliable unbroken communication when transmitting information through and around natural and man-made structures.

It is a further object of the present invention to provide a system, using the railroad tracks, which transmits a signal to trains or equipment operators or dispatchers or other regional or national traffic control personnel, and which allows users to determine the proximity of such equipment, including the speed, track, location and direction of travel.

An additional beneficial aspect of the present invention is its ability to detect anomalies, defects, or discontinuities in the track itself. This is accomplished by virtue of the transmission and reception of signals through the rail. Such signals or reflected signals would necessarily be altered by anomalies, defects, or discontinuities in way such that they could be compared to a database of recorded anomalies derived from tests or samples taken from sections of track with known existing defects, or compared with a range of conditions considered to be normal in existing rail systems, or compared to both.

The objects of the present invention are accomplished by a method of transmitting information through a railroad track or other electrically conductive rail equipment,(e.g. trainline or cantenary) which involves an introduction of a signal containing information at a first location on the track or conductor and the detection of the signal which contains the information transmitted through the rail or other conductor to a second distant location. Subsequently, the information is extracted from the detected signal.

The objects of the present invention are further achieved by an apparatus which transmits information through the railroad track using a signal source which outputs an information encoded signal into either one or both of the rails of a track. A remotely positioned receiver detects the encoded signal transmitted through the track and then extracts the information from the signal.

It is a further object of the present invention to provide a method for transmitting information by the introduction into the rail, at a first location, of a radio frequency signal containing the information and subsequently detecting the signal at a second location, which is remote from the position where the signal was introduced into the track. The information is then extracted from the transmitted radio frequency signal and analyzed. It is a further object of the invention to provide a method of transmitting information through a railroad track by introducing an acoustic signal containing the information into the railroad track at a first position. At a remote position, the acoustic signal which was transmitted through the railroad track is detected and the information is extracted from the transmitted acoustic signal and then processed.

According to yet another method of the present invention, specific information, transmitted as a specific, universally known form of signal along a railroad track, is received by detecting a plurality of audible signals at a position which is remote from the source of the specific audible signal. Subsequently, the detected plurality of signals are analyzed and the specific audible signal is isolated. The specific audible signal is then processed to provide the specific information.

Other objects, advantages and novel features of the present invention will become apparent from the following detailed description of the invention when considered in conjunction with the accompanying drawings.

DETAILED DESCRIPTION OF PREFERRED EMBODIMENTS

Figure 1:
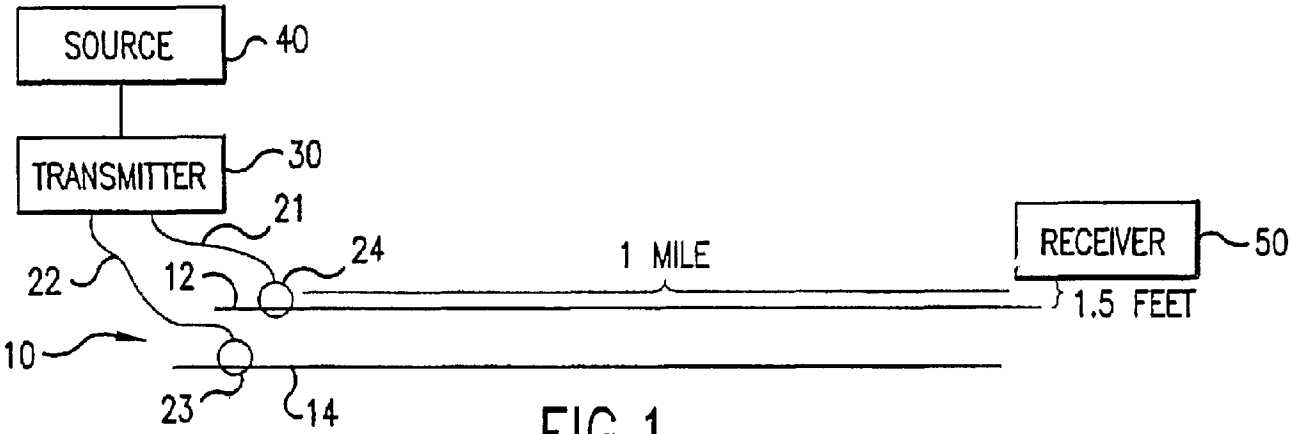
FIG. 1 is a schematic illustration of a method of radio frequency transmission according to the present invention.

FIG. 1 illustrates the use of a one mile length of main line welded 140-pound steel rail 10, as a transmission medium. The in situ track 10 was evaluated using an auto-ranging digital multimeter which established that the resistance between the two opposite rails 12, 14 was approximately 3.5 ohms. The differential alternating voltage measure between opposing rails indicated only normal background voltage transients, that is to say, that whether or not the volt meter was connected to the rail, there was no difference in the measured voltage. In a similar manner, the D.C. differential voltage was measured as essentially zero. A copper grounding rod was inserted approximately 15 inches into the soil to evaluate the voltage differential of each track relative to ground. There was approximately a 1 volt DC voltage measured with respect to ground for each of the rails.

Subsequently, each of two equal lengths of 14 gauge insulated stranded copper wire 21, 22, approximately 15 feet in length, electrically attached, on one end to each of two steel, 14 inch automotive rims 23, 24. The opposite ends of the copper wire were attached to the positive and negative dipole terminals of a 194.5 kHz AM (L. F.), 500 mW transmitter 30, that utilizes a 30 kHz FM sub-carrier to transmit audio (stereo) identified as a CYBERNET, model TM-301 (FCC ID # AWQ9SBTM-301), having an effective power output of approximately 200 mW at 100 percent modulation at 1 kHz. This was determined by using a Wavetek audio generator, model 112 B, set for standard sine wave output, that was used to provide the 1 kHz tone to the line level input of the Cybernet TM-301. The audio gain of the TM-301 was then adjusted so that the modulation LED was in a steady "ON" condition, indicating 100 percent modulation. The RF power output of the Cybernet TM301 was then measured across the positive and negative dipole antenna terminators.

The steel automotive rims connected to the wire coming from the transmitter were prepared by removing all paint and corrosion from the inner surfaces and from one of the lug holes to permit maximum electrical conductivity between the connection wires, rims, and train tracks. The rims 23, 24 were placed opposite each other on the tracks in a vertical orientation in order to simulate two train wheels on a track.

A musical program material source 40 was used to modulate the Cybernet transmitter 30 in order to determine the effective transmission range with the matching receiver headset 50. The receiver headset was a Cybernet model HT-WL38 portable headset receiver equipped with auto-squelch.

The receiver 50, was moved away from the transmission source (where the wheels were placed on the track). Beginning at about 500 yards, there was detectable attenuation of the RF signal as evidenced by muting at a full standing position resulting from the auto squelch feature of the receiver. However, the signal was clearly discernible at approximately a one mile distance from the transmission source, monitored no closer than 1.5 feet above the tracks. Because the power output of the test transmitter was substantially less than one-half watt (200 mW), it is apparent that longer transmission distances could be readily achieved by using a transmitter with higher output power under similar conditions.

Figure 2:
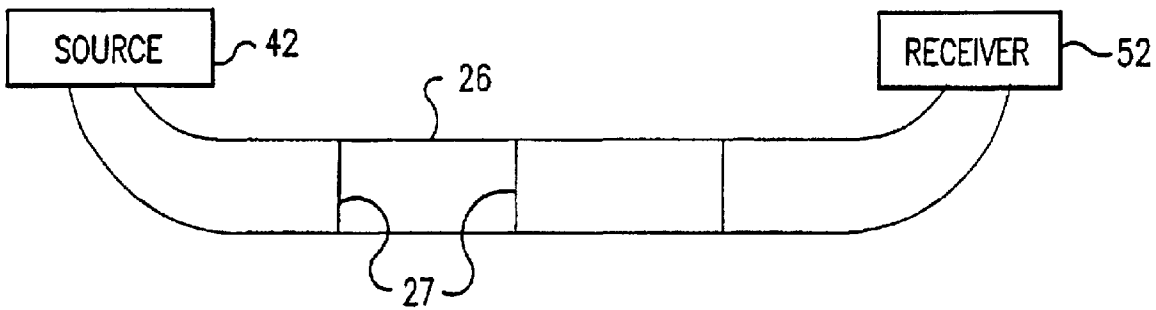
FIG. 2 as in illustration of the effectiveness of the method illustrated in FIG. 1 when taking into account the shunting effect of the axles of trains and other moving equipment.

In order to take into account the varying electrical conditions that could exist in the railroad track environment, including the effect of the train itself, the system of FIG. 2 was used to perform several experiments using heavy gauge copper wire 26, connected in such away as to resemble a wire ladder with the "rungs" 27 simulating train axles. Although each successive shunt reduced the RF signal from the source 42, the original signal, as detected by the receiver 52, remained after multiple shunts. This test was conducted because of the nature of modern train axles, wherein each wheel on the same solid, electrically conductive axle would act as a shunt or short-circuit.

With respect to precise conditions of a long train running along a continuous length of track, it is apparent that higher transmitting power would negate the effect of these "shunts". However, it was later discovered through further testing that the RF signal introduced into the body of a locomotive will not only propagate into the rail in both directions, it also propagates through the body of the locomotive and any cars attached to it. Furthermore, even if a worst-case scenario develops where the shunts cause an unacceptable signal attenuation, the signal could be transmitted from both ends of the train to overcome this problem. This may be accomplished by utilizing the trainline (the standard airline hose connection between the locomotive and cars to activate the train's brake system). The trainline is an electrically conductive line, running continuously along the entire length of the train, connected at each car by means of a conductive "gladhand". This is accomplished by insuring continuity between the hose's reinforcing wire mesh component and its couplings. Alternatively a catenary, or a third rail could also be utilized to transmit the signal utilizing a suitable coupling device(to prevent high voltage damage to transmission equipment).

Aside from these minor problems, the shunting of the two tracks by the first axle (the point of detection) of an approaching or departing train is an beneficial aspect of the application because it provides a closed loop "antenna" which actually improves signal strength and also provides valuable signal phasing information, which is important when several trains are located in the same vicinity.

Figure 2A:
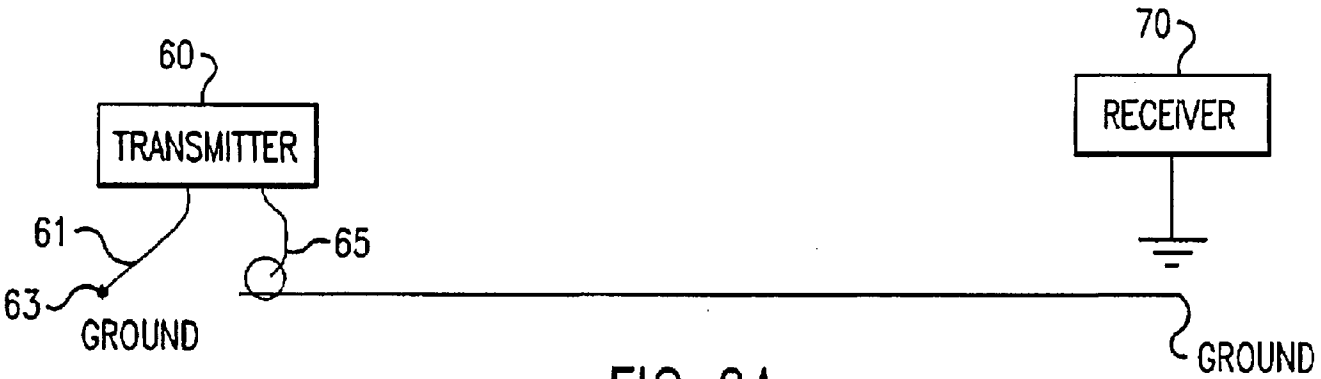
FIG. 2*a* is an illustration of the effectiveness of the use of a single track transmission method where the chassis of the train is used as a relative ground communicating with the opposite grounded track.

Furthermore, a single conductor "antenna" (or transmission line) track can work equally well for transmission, as shown in FIG. 2*a*. The negative side 61 of the antenna dipole is connected to a grounding rod 63, and the positive side 65 to 1000 feet of eight gauge insulated stranded copper wire 68 that is run in a straight line from the transmitter 60 and is grounded at the far end. The musical program source was readily detectable at the far end by receiver 70. This condition can be simulated on a train by connecting the ground side of the transmitter to the chassis of the train, which is electrically continuous with its metal wheel, and grounding one of the rails at regular intervals. This would require the use of an inductor or wheel, insulated from the chassis of the train to introduce or receive the signal on the opposite rail.

Figure 3:
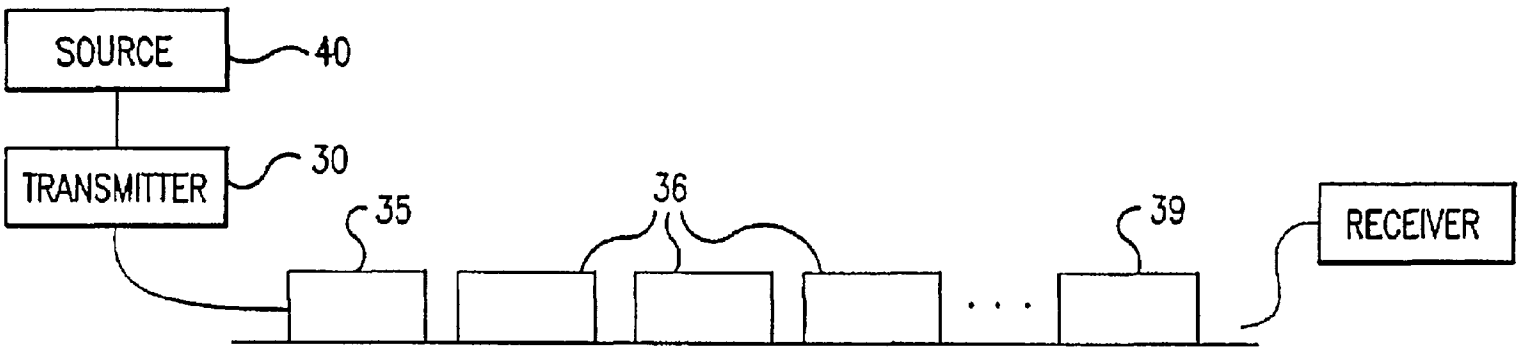
FIG. 3 is a schematic illustration of the method using a length of railroad tracks have train cars.

FIG. 3 illustrates an additional test previously referred to and a variation of the testing of rail communications involving a section of tracks occupied by a locomotive, cars and a caboose. A test section using tracking equipment in very poor conditions was used to emphasize the functioning of the method under less than ideal conditions. The length of rail illustrated in FIG. 3 contained a locative 35 and a caboose 39 with 10 cars 36 of various types and lengths. The track was sectionally connected together with bolts and fastening plates (not welded) and attached to wooden ties with typical gravel bedding. Several of the bolts used to fasten the track together were missing and the track was separated at these points and sections of up to six inches were missing. Cars and wheels, as well as the track exhibited significant rust on the exterior surfaces and couplers.

The same test equipment as used in the FIG. 1 configuration was set up. The front wheels of the locative were connected at a the appropriate connection point to the transmitter through 14 gage multi strand wire. A small hole drilled near the journal bearing approximately 3/16" in diameter was selected as the signal injection point. The hole was prepared by scrapping its interior with a small flat plated screwdriver. Thereafter, a stripped end of the 14 gage wire was inserted into the hole. A small screw was then chased behind ensuring a positive electrical connection to the wheel. Several areas of the wheel, axle and track were scrapped and tested for resistence. The resistence was effectively 0 ohms. Both right and left front wheels of the locomotive were identically prepared. In another aspect of the experiment, the antenna lead from the transmitter was connected to the body of the train, away from the wheel in areas where the chassis could be scrapped back to bare steel.

With the signal introduced in both front wheels of the locomotive, via the journal bearing, the audio signal was discernable along, in between and directly above the track and in the couplers traveling away from the locomotive. The signal was slightly attenuated but discernible to the end of the track at the car body level, at both rails and in between both rails. In a test of the experiment wherein the RF signal was introduced into the body of the locomotive above the wheels, the signal was attenuated at approximately the seventh car at the higher coupler level but was still discernible at the rail moving toward the caboose. With the signal introduced into one wheel and with the other end of the antenna dipole grounded by a three foot section of cooper pipe hammered 2.5' into the ground, the same results were noted as in the first test when connected directly to the journal bearing of the wheel. However, the signal seemed to be somewhat stronger. There was no loss previously noted around the seventh car. With a single lead attached to the chassis of the locomotive, again the same findings were observed. In all cases, the signal dissipated when moving laterally away from the train and tracks.

The method of introduction of a LF signal into the rail and/or train seems not to be critical. The test conditions of the equipment and tracks show that no operating railroad would provide more adverse conditions. Electrical shunts caused by electrically continuous wheels and axles do not seem to present a obstacle because it is likely that the signal travels along the body of the train itself and thus would be reintroduced to the track at the end of the train. This methodology can also be used to transmit intratrain communication on a different sub-carrier. Furthermore, if the airlines which are required on each car for an air brake operation were electrically conductive, through the use of, for example, a wire mesh hose that was electrically continuous, a consistent electrical connection throughout the length of the train could be achieved.

In order to take into account extended lengths of track of more then 10 miles, instrumentation at the injection location will likely require an additional amount of wattage. Approximately 100 watts of output power tuned to the RF test frequency should be more than adequate. For purposes of such a wattage production, a high power linear amplifier such as the AR (Amplifier Research) model 100L can be used which operates over a frequency range of 10 KHz to 220 MHz and has a minimum output of 100 watts CW at maximum gain. The measurement of the amplifier output power is accomplished by a directional coupler, HP power meters and a coaxial load. The coupler can be a Werlatone model C1460 which operates over the 10 KHz to 250 MHz frequency range. The coaxial load could be a Bird model 8201 which operates from DC to 1000 MHz. The measurement of the forward and reflected powers at the coupler ports determine the transmitted power into the load. The AR amplifier can be driven by HP model 8656A generator which operates from 100 KHz to 990 MHz and can operate down to 10 KHz in an under range mode. This 8656A generator can be modulated at 400 Hz or 1000 Hz and has an external modulation input that can be modulated between 25 Hz to 25 KHz. This internal modulations of 4,000 Hz can be operated simultaneously or as mixed modulations involving AM-AM, FM-FM, or AM-FM.

Matching apparatus at the receiving location can include a Fairchild model ALR-25 loop antenna which has an 18 inch diameter and a switchable matching network for direct bands. The loop operates over the 10 KHz to 30 MHz frequency range and is oriented at the test location to maximize the received signal. From the loop antenna, the output can be fed to an Eaton EMI field intensity meter such as model NM-7A which operates over the 0–50 KHz range with band widths of 10 AZ, 100 HZ, 1 KHZ, 20 KHZ and 50 KHZ. This meter has a BNC coaxial input which can be operated from AC power or from internal rechargeable batteries.

With respect to the connection at the input end, the AR amplifiers have unbalanced coaxially outputs. Ideally, a balance tuner is connected to the output of the amplifier so that the signal can be matched into the rails. The balance tuner would have a coaxial input and a balanced output. As an alternative, a balun can be used without a matching network because the AR amplifier is designed to operate in high VSWR's without damage. With this environment, a balun which can operate in the 30–300 KHz range and can handle the 200–500 watts is required.

As an alternative to a balanced output approach, a single rail can be loaded with a coaxially output having the shielded conductor connected to ground. A loop antenna having one lead grounded would be used for the reception. Such a single rail configuration would have a lower impedance in order to provide matching without a balun.

The transmission and reception of waves, through the wheel, or other transducers mounted on a locomotive or other track equipment, into the rail, can be picked up directly through the rail by other locomotives and track equipment, or by a fixed or portable receiver or dispatch center. The signal may also been coded with information directly input by the railroad personnel or other parties. This encoded information is transmitted and picked up by other equipment, either on board the train or remotely located. Therefore, any moving or stationary train may transmit information, to other locomotives or receivers, relative to speed, direction, location, and distance, as well as other information that may be encoded into the signal. This encoded information can be digital or analog (e.g. audio) and can be converted by a computer or audio radio detector either on board another piece of equipment or at a location positioned off the rails. The information can be derived from or shared with other equipment located onboard a train or located on or off the track, such as data recorders, telemetry devices, geographical/global positioning devices.

The transmission of radio frequency waves is a preferred aspect of the present invention. There are several radio frequencies which can be identified as suitable for transmission through the rail without creating interference with existing radio frequency communications controlled by the Federal Communications Commission (FCC). Furthermore, these frequencies can be transmitted and received over relatively long distances along the rail without experiencing significant signal strength loss or without presenting an environmental hazard to either personnel or wildlife. LF (low frequency, 30 kHz to 300 kHz), VLF (very low frequency, 3 kHz to 30 kHz) ELF),(extremely low frequency, 3 Hz to 3 kHz) and ULF (Ultra low frequency, <3 Hz) signals are particularly suitable for this rail communication system. These low frequency, long wavelength radio frequencies are ideal for use with the railroad because the antenna loading characteristics of the rail, catenary, or similar power transmission lines (effectively an infinite length transmission line) are very conducive for use with long wavelengths because problems with attenuation due to "antenna" mismatching are minimized. Furthermore, as a result, standing wave ratios (SWRs) would be acceptable thus minimizing point-source radiated energy leakage. This rail communication system provides a safe environment for life forms in close proximity to the rail. Radiation of the RF signal at substantial distances away from the rail is also minimized because of the wave propagation characteristics of these low frequencies and the horizontal and parallel configuration of the rail. Additionally, there is very little commercial use of radio frequencies in this lower part of the spectrum. The chance of interference with commercial radio frequencies is minimal because higher band harmonics would not be produced at sufficient signal strength to interfere with modern receiving equipment.

Because of the nature of the radio frequency electromagnetic waves, embedded information in a digital or analog format, can be carried along with the wave, or its sidebands, or by frequency modulated (FM) waves. As an example, relatively accurate location information derived from existing conventional global positioning systems (GPS) equipment located on board each train can be transmitted via the RF carrier. Furthermore, information from parties such as workers, trains in distress, trains located in "dark" areas etc. can be used to contact other trains, or off track railroad facilities. The system can be implemented as either an conventional communication system, emergency system, highway grade crossing signal, positive train control system, freight tracking system, or as a commercial service for a fee.

The physical characteristics of the rail itself can be detected as a result of changes in the waveform, resulting from interference or resistance within the steel rail, to the transmitted waves of these low frequency systems. Variations in the waveform, phasing, amplitude, or interruptions of a transmitted or reflected signal are used to provide inherent information concerning the condition of the rail or the speed of a moving transmitter located on the rail. Detection of the condition of the rail, or the speed of approaching equipment, can be enhanced by the addition of a calibrated audio signal in combination with the RF component. Furthermore a secondary HF or UHF signal can be used, as a reference, as well as a redundant signaling device along with the main low frequency rail signal. Small discrepancies in the Wave phasing in/timing can be detected by a comparator, as long as both high and low frequencies share a common clock, because both signals will travel at roughly the same speed ($3\times10_8$ M/sec, in free space, and somewhat slower, yet predictable speed through steel rail). Phase analysis of any signals received directly from, or reflected back from a transmitting train can be used to detect the condition of the rail. This phase analysis is accomplished by phase analysis computer software.

By the nature of the radio frequencies, it is possible to simultaneously transmit information from one position to another and provide additional information concerning the track conditions between the two sources. That is, the radio frequency may be modulated beforehand with the necessary information to be transmitted from the first position to the second position. As it is transmitted along the rail, the aforementioned physical characteristics can be detected as a result of the changes in the wave form or envelope. These variations may be the phase, amplitude or interruption. Therefore, at the second position, there is an ability to not only remove the specific information sent from the first position but there is also the ability to determine the physical characteristics of the rail between the two positions. In a simplified example, a radio frequency signal modulated with information A is sent out. Normally, with perfect track conditions, the information received at the second position would have an amplitude or a signal level of a certain value because of the distance between the two locations. On the other hand, if there was a deterioration in the track conditions, the signal level may be significantly lower or have a different phasing. The original information A sent from the first position can still be determined but the characteristics of the received signal, aside from the information contained in the received signal, will provide the additional information concerning the track condition.

Deployment of this communication system on an operational railroad system will also provide valuable information about approaching trains that would otherwise be extremely difficult to detect with other technologies. For example, the RF signal can be transmitted into the right-side rail (relative to each train) in order to determine whether an approaching train is closing on another train from the front or the rear on the same track. Alternately, a convention can be adopted which would dictate that moving trains, headed from zero degrees through 1.80 degrees, transmit on one frequency, and trains headed from 181 degrees through 360 degrees, relative to true north or magnetic north, transmit on another frequency. Specific differential information is only possible because the system uses the rail as its transmission medium. By comparison, global positioning systems (GPS) on board two trains might indicate that the trains were approaching each other, however, without extremely high resolution, generally unavailable with commercially available GPS systems, this method would be unable to differentiate whether the trains were on the same track or two adjacent tracks, separated by only a few feet.

Automated or manually operated transmitting/receiving units can be installed on various railroad crossings, bridges, and intersections with the railroad to provide additional advanced warning, such as an emergency voice communication or visible light or infrared video detection, or sound proximity devices used to warn of potential obstructions. This system can be used to act as a redundant safety system to activate highway-rail-warning systems, or be used to replace the existing, high maintenance grade crossing system.

In addition to radio frequencies, steel railroad tracks are an excellent transmitter of sound. It has long been known that sound can be detected through the rail system from great distances. Modern computer technology can digitize and analyze the sound transmitted through the rail. Therefore, use of an acoustic signal (i.e. sound waves) is a viable approach for detecting approaching trains, stationery or moving obstructions along the tracks and/or structurally defective rails over a given length of track. Sound traveling over and along the track may be generated either passively or actively by a train or equipment mounted on the train.

The digitizing of passively generated by sounds detected by a microphone or optical detection system in contact with a rail, or in close proximity to the rail, enables a discrimination of sounds inherently generated by a train or other objects in contact with the rails. These digitized sounds are separated from other sounds on the same track by comparing the phrase relationship, frequency, frequency shift and amplitude of all detected sounds processed by a computer algorithm, with or without direct comparison to already stored digital samples. Defects in the rail or discontinuous sections of the rail can also be detected in a similar manner. In other words, it is possible to catalog sounds associated with various events and conditions occurring along a railroad track during normal and abnormal operation in order to provide a differential database that can be used to determine possible dangerous conditions.

Another approach, for the use of sound in railroad communication, involves the active introduction into the rail of continuous or pulsed sound of a standardized frequency and interval, not typically associated with normal railroad sounds, which serves as a SONAR-like signal that can be detected and analyzed at considerable distances. Because this active signal is standardized, its original characteristics are known precisely, and hence any differences in the received signal can be attributed to the movement, or lack of movement, of equipment or objects over the rail, or on the rail, and the characteristics of the rail itself.

Figure 4:
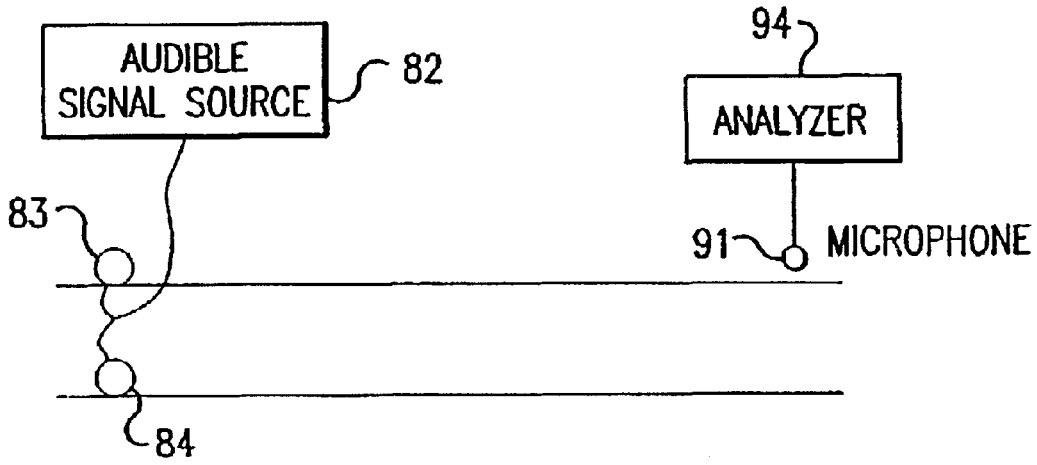
FIG. 4 is in illustration of the audible frequency transmission method according to the present invention.

FIG. 4 shows the introduction of sound from the active source 82 through existing train rails 83, 84. The source 80 may be an oscillator/amplifier fitted on, or attached to the wheels 82, 83 or a resonant inductor placed directly over the track, capable of generating the desired acoustic signal at all rail vehicle speeds. Placement of equipment 2.5 inches, or more over the track is permissible under current regulatory guidelines. The reception of the active acoustical signal can occur through a wheel equipped with a microphone device 91 or optical device may use reflective coherent light such as a laser. This detection occurs directly from the rail surface. Correction for inherent movement associated with a train in motion is achieved by the use of an extremely sensitive, phase coupled motion detecting device, fitted with an optically transparent loop, placed directly into the path of the transmitted control laser beam. Information from this device is fed into a computer or other signal processor 94, along with information from the reflected laser beam coming from the track which is then used to provide corrective information used to compensate for the spurious movement and/or vibration associated with the moving train and source laser.

The introduction of an active sound source into the rail system can be, as discussed above with respect to a radio frequency implementation, introduced only into the right side rail of all trains (relative to the train) to provide immediate identification of trains moving toward each other on the same track as opposed to traveling in the same direction. Further at a convention can be adopted which would dictate that moving train headed from zero degrees through 180 degrees transmitted on one frequency, and trains headed from 181 degrees serves 360 degrees relative to magnetic or true North is transmitted on another frequency.

The foregoing description has been set forth merely to illustrate the invention and is not intended to be limiting. Since modifications of the disclosed embodiments incorporating the spirit and substance of the invention may occur to persons skilled in the arts, the invention should be construed to include everything within the scope of the appended claims and equivalents thereof.

What is claimed is:

1. A method of transmitting information data through a railroad track, comprising the acts of:

introducing into said railroad track at a first position, a radio frequency signal containing said information data;

detecting at a second position remote from said first position on said railroad track, said radio frequency signal containing said information data, which was transmitted through said railroad track between said first and second positions; and extracting said information data from said detected radio frequency signal and analyzing said information data.

2. The method according to claim 1 further comprising the act comparing characteristics of said detected radio frequency signed with predetermined characteristic in order to provide additional information acquired by said radio frequency signal during transmission between said first and second position.

3. The method according to claim 2, wherein said addition information is track condition information between said first and second positions.

4. The method according to claim 1, wherein said second position is fixed with respect to said first position.

5. The method according to claim 1, wherein at least one of said first and second positions is moving with respect to said railroad track.

6. The method according to claim 1, wherein said information data from said detected radio frequency signal is at least one of a speed of a train at said first position, a location of said first position, and information received at said first position from a third position.

7. The method according to claim 1, wherein said radio frequency signal is a LF signal having an output power of less than one half watt, and wherein the distance between said first and second positions is approximately one mile.

8. A method according to claim 1, wherein the act of introducing a radio frequency signal into said railroad track at a first position includes the act of introducing said radio frequency signal into each rail of said railroad track.

9. The method according to claim 1, wherein the act of introducing a radio frequency signal into said railroad track includes the act of introducing said radio frequency signal into one of two rails of said railroad track.

10. The method according to claim 1, wherein said first position includes a railroad car and wherein said act of introducing into said railroad track at a first position a radio frequency signal containing said information data includes the simultaneous act of introducing said radio frequency signal containing said information data into said railroad car and propagating said radio frequency signal along the length o f said car.

11. The method according to claim 1, wherein said radio frequency signal is a LF signal.

12. The method according to claim 1, wherein said radio frequency signal is a VLF signal.

13. A method of detecting information concerning a railroad track between a first position and a second position on said railroad track, comprising the acts of:

introducing into said railroad track at said first position, a transmission modulated radio frequency signal;

detecting at said reception position remote from said position on said railroad track, a reception modulated radio frequency signal which was transmitted through said railroad track between s aid first and second position;

comparing said characteristics of said detected reception request radio frequency signal with predefined characteristics of said transmission modulated radio frequency signal to provide said information concerning said railroad track between said first and second position.

14. The method according to claim 13, wherein said second position is fixed with respect to said first position.

15. The method according to claim 13, wherein at least one of said first and second positions is moving with respect to said railroad track.

16. The method according to claim 13, wherein said transmission modulated radio frequency signal introduced into said railroad track contains information data and wherein said act of comparing said detected reception signal includes the act of extracting said information data from said detected reception radio frequency signal.

17. A method of transmitting information through a railroad track, comprising the acts of:

introducing into said railroad track at a first position a radio frequency signal modulated with acoustic information;

detecting at a second position remote from said first position on said railroad track, said radio frequency signal containing said acoustic information which was transmitted through said railroad track between said first and second position;

extracting said acoustic information from said detected radio frequency signal and processing said acoustic information.

18. The method according to claim 17, wherein said acoustic signal is an audible signal.

19. The method according to claim 17, wherein said second position is fixed with respect to said first position.

20. The method according to claim 17, wherein at least one of said first and second positions is moving with respect to said railroad track.

21. The method according to claim 17, wherein said radio frequency signal is a LF signal.

22. The method according to claim 17, wherein said radio frequency signal is a VLF signal.

23. An apparatus for transmitting information through a railroad track, comprising:

a signal source outputting a radio frequency signal having a modulated carrier containing said information;

interface means for connecting said output of said signal source to at least one rail of said railroad track at a first position;

a receiver detecting said modulated radio frequency signal which was transmitted from said first position to a second position remote from said first position through said at least one rail wherein said receiver further includes a device for extracting said information from said detected radio frequency signal.

24. The apparatus according to claim 23, wherein said second position is fixed with respect to said first position.

25. The apparatus according to claim 23, wherein at least one of said first and second positions is moving with respect to said railroad track.

26. The apparatus according to claim 23, wherein said radio frequency signal is a LF signal.

27. The apparatus according to claim 23, wherein said radio frequency signal is a VLF signal.

28. A method of detecting a radio frequency signal containing specific information transmitted along a railroad track, comprising the acts of:

detecting a plurality of signals at a position remote from a source of said radio frequency signal;

analyzing said detected plurality of signals and outputting said radio frequency signal;

processing said radio frequency signal to provide said specific information.

29. A method according to claim 28, wherein said plurality of signals include both acoustic and extraneous radio frequency signal.

30. A method of checking railroad track condition, comprising the acts of:

introducing a radio frequency signal into said railroad track at a first position:

detecting as reflected radio frequency signal wherein said reflected radio signal includes said first radio frequency signal after reflection at a second position on said railroad tracks; and comparing characteristics of said detected radio frequency signal with predetermined characteristics of said first signal in order to determine track condition information between said first position and said second position.

* * * * *